US011053718B2

(12) United States Patent
Finley

(10) Patent No.: US 11,053,718 B2
(45) Date of Patent: Jul. 6, 2021

(54) REMOVABLE, REMOTELY-CONTROLLED DOOR LOCKING APPARATUS

(71) Applicant: Bancroft Resource Management, LLC, Arlington, VA (US)

(72) Inventor: Kenneth Finley, Arlington, VA (US)

(73) Assignee: STIFF ARM LLC, Arlington, VA (US)

( * ) Notice: Subject to any disclaimer, the term of this patent is extended or adjusted under 35 U.S.C. 154(b) by 838 days.

(21) Appl. No.: 15/866,265

(22) Filed: Jan. 9, 2018

(65) Prior Publication Data

US 2018/0148960 A1 May 31, 2018

Related U.S. Application Data

(63) Continuation-in-part of application No. 14/876,746, filed on Oct. 6, 2015, now abandoned.

(51) Int. Cl.
*E05C 19/00* (2006.01)
*G07C 9/00* (2020.01)
(Continued)

(52) U.S. Cl.
CPC ..... *E05C 19/003* (2013.01); *G07C 9/00182* (2013.01); *E05B 45/06* (2013.01);
(Continued)

(58) Field of Classification Search
CPC ..... E05B 2045/063; E05B 2045/064; E05B 2045/067; E05B 2045/068; E05B 2045/065; E05B 45/06; E05B 47/0012; E05B 2047/0058; E05B 2047/0094; E05B 2047/0095; E05B 2047/0016; E05B 2047/0048; E05B 2047/0097; E05B 63/0056; E05C 17/44; E05C 17/54; E05C 17/525; E05C 17/446; E05C 17/58;
(Continued)

(56) References Cited

U.S. PATENT DOCUMENTS 217,762 A 7/1879 Witte
3,124,382 A * 3/1964 Strother ..... E05C 19/004 292/343
(Continued)

FOREIGN PATENT DOCUMENTS

KR 101282085 B1 * 7/2013 ..... E05B 47/0012
WO WO-2014056109 A1 * 4/2014 ..... G05B 15/02

*Primary Examiner* — Christine M Mills
(74) *Attorney, Agent, or Firm* — Charter IP LLC; Matthew J. Lattig

(57) ABSTRACT

In order to secure a door in a locked (or locked open) position without a key, such as to resist a forced entry through the door, a removable, remotely-controlled door locking apparatus is provided, which includes a rear plate for attachment against a surface of a door, a cover for enclosing components on the rear plate, and a telescoping arm assembly connected to the rear plate and extendible so that the other end attaches to a door knob. A DC-powered linear actuator connected to the rear plate and at least one electronics module configured to communicate wirelessly is within the cover. A foot of the actuator is configured to be extended in a lock state against a floor surface to secure the door or retracted in an unlock state, based on a wireless signal received from a remote smart device to control the actuator.

19 Claims, 9 Drawing Sheets

(51) Int. Cl.
*E05B 45/06* (2006.01)
*E05B 47/00* (2006.01)

(52) U.S. Cl.
CPC ..... *E05B 47/0012* (2013.01); *E05B 2045/063* (2013.01); *E05B 2045/065* (2013.01); *E05B 2047/0016* (2013.01); *E05B 2047/0048* (2013.01); *E05B 2047/0095* (2013.01); *G07C 9/00309* (2013.01); *G07C 2009/0019* (2013.01)

(58) Field of Classification Search
CPC ..... E05C 19/004; E05C 19/18; E05C 19/188; E05C 19/003; Y10T 292/34; Y10T 292/37; Y10T 292/394; Y10T 292/65; Y10T 292/67; Y10T 292/71; Y10T 292/73; Y10S 292/15; Y10S 292/25; Y10S 292/28
See application file for complete search history.

(56) References Cited

U.S. PATENT DOCUMENTS 3,829,834 A * 8/1974 Frankland ..... G07C 9/0069 340/543
3,989,286 A * 11/1976 Cieff ..... E05C 17/446 292/144
4,019,765 A * 4/1977 Nichola ..... E05C 19/004 292/338
4,358,758 A * 11/1982 Morton ..... E05C 19/004 200/61.93
4,442,427 A * 4/1984 Morton ..... E05C 19/004 200/61.93
4,483,558 A * 11/1984 Van Meter ..... E05C 19/004 292/339
4,607,253 A * 8/1986 Wooten ..... E05C 19/004 200/61.93
4,883,297 A * 11/1989 Smith ..... E05C 19/004 292/339
4,971,374 A * 11/1990 Lovell ..... E05C 21/00 206/231
4,973,093 A 11/1990 Olszowka
5,216,909 A * 6/1993 Armoogam ..... E05B 47/0002 292/144
5,250,927 A * 10/1993 Nevels ..... G08B 13/08 200/61.93
5,340,175 A * 8/1994 Wood ..... E05C 19/004 292/339
5,392,026 A * 2/1995 Marik ..... G08B 13/08 200/61.49
5,618,072 A * 4/1997 Pitchford ..... E05C 19/004 292/339
5,725,263 A * 3/1998 Rodriguez ..... E05C 17/48 16/82
5,971,450 A * 10/1999 Suarez ..... E05B 65/0888 292/289
5,988,710 A * 11/1999 Kortschot ..... E05C 19/004 292/272
6,116,067 A * 9/2000 Myers ..... B25H 3/028 292/341.16
6,557,915 B1 * 5/2003 Duff ..... E05C 17/54 292/343
6,580,355 B1 * 6/2003 Milo ..... E05B 47/0012 340/5.7
D504,301 S 4/2005 Wood
7,021,683 B2 * 4/2006 Nissen ..... E05C 19/004 292/339
7,096,698 B2 * 8/2006 Walsh, III ..... E05B 47/0012 70/149
7,164,356 B1 * 1/2007 Zeitz ..... G08B 13/08 292/338
8,496,278 B2 * 7/2013 Lee ..... E05C 19/004 292/339
9,644,396 B2 * 5/2017 Grow ..... E05B 65/025
2004/0070217 A1 * 4/2004 Demlow ..... E05C 19/188 292/339
2005/0225099 A1 10/2005 Quarberg
2009/0102207 A1 * 4/2009 Kim ..... E05C 17/443 292/338
2009/0139050 A1 * 6/2009 Junkins ..... E05C 17/54 16/84
2009/0322473 A1 * 12/2009 Aliferis ..... E05B 47/026 340/5.7
2012/0133517 A1 * 5/2012 Brausteiner ..... E05B 45/06 340/626
2012/0235428 A1 * 9/2012 Blacklaws ..... E05C 19/004 292/338
2013/0237193 A1 * 9/2013 Dumas ..... G07C 9/00571 455/414.1
2014/0375070 A1 12/2014 Hatton et al.
2015/0042109 A1 2/2015 Hatton et al.

* cited by examiner

REMOVABLE, REMOTELY-CONTROLLED DOOR LOCKING APPARATUS

CROSS-REFERENCE TO RELATED APPLICATIONS

The present application claims the benefit under 35 U.S.C. § 120 and is a continuation-in-part of U.S. patent application Ser. No. 14/876,746 to Finley, et al. (the "'746 application"), filed Oct. 6, 2015, pending. The entire contents of the '746 application is hereby incorporated by reference herein.

BACKGROUND

Field

The example embodiments in general are directed to a door locking apparatus, more particularly to an apparatus adapted to provide resistance to a forced entry through the door.

Related Art

It may be desirable in many situations to increase the security on a door by, for example, installing a stronger lock or additional locks or bolts at additional locking points around the door. However, it is not always possible or convenient to make these types of permanent installations on a door, for example in a rented home or office, a hotel or hostel room, or in student accommodations.

Thus, in these situations it may be desirable to increase door security using non-permanent means. One well known method is to jam a chair under the door handle, but unless the chair is of proper size and construction, this will not hold the door for long. Another solution of jamming a door closed is by locating a bar at an angle between the door handle and the floor behind the door. While this is an improvement over the use of a chair, the connection between the bar and the door handle is prone to failure, and the bar can extend significantly beyond the door, presenting a trip hazard.

One conventional improvement to the angled bracing bar noted above is shown in FIG. 1. This prior art door brace 10 includes an outer, lower tube 13 within which reciprocates an inner tube 12. The brace 10 is secured at its upper end to a doorknob on a door 14 and has a pivoted foot 17 designed to contact floor 16. A pivot arm 18 normally held in a horizontal position rests against the door 14 to hold the brace 10 at an angle to the door 14.

With brace 10 in its extended condition, the foot 17 engages the floor 16 and prevents the door 14 from swinging to the left. This is accomplished by an internal motor 19 supplied with electrical current from batteries 29. As is well known, the DC motor 19 under power from batteries 29 extends and retracts the inner tube 12 within outer tube 13, so as to raise and lower foot 17. Motor 19 is connected to a gear reduction unit 32 with a recess 33 to receive a splined shaft 34 projecting from the lower tube 13. The splined shaft is rotated by the reduction gears 32 and it is connected to a threaded shaft 36 which threads into a non-rotatable nut 37 secured to the upper end of the inner tube 12. The inner tube 12 (and the nut 37) are prevented from rotating by a pin 38 projecting from the inner tube 12 into a longitudinal slot 39 in the outer tube 13.

The motor 19 is controlled by a radio receiver and associated electronics 21 which may be an off-the shelf arming and disarming circuits. As this brace 10 was developed pre-internet and prior to the smart phone age, coded radio signals are employed. Namely, coded radio waves are sent directly to a radio receiver 21 by a hand held transmitter (not shown). When the code supplied by the transmitter is identical to the code recognized by the receiver 21, the brace 10 under motor 19 control will extend or retract inner tube 12 with the foot 17 attached to the distal end thereof, depending upon the state of a flip-flop in the electronics of the receiver 21.

A more current, commercially available conventional door brace, known as the DOORJAMMER™ (sold by Gitway, Inc.) is shown in FIG. 2. The door brace 10' includes a door engagement member 12', a leg 20 and an engagement foot 26'. The door engagement member 12' comprises a bottom flange 14' and an engagement wall 16'. The bottom flange 14' is located under a bottom edge of a door 34', as shown in FIG. 2. The engagement wall 16' extends generally upwardly from the bottom flange 14'. One face 18' of the engagement wall 16' is located against part door 34', at the bottom edge as shown in FIG. 2. The engagement wall 16' and bottom flange 14' together define a generally L-shaped recess for receiving part of the door 34' at its bottom edge.

The leg 20 comprises a fixed length section 22 and an adjustable length section 24'. In this embodiment, the fixed length section 22 has an angled shape and comprises a first part 22*a* and a second part 22*b*. The first part 22*a* extends in a first elongate direction and the second part 22*b* extends in the second elongate direction. In the bracing position, the first part 22*a* extends at a first angle to the face 18' and the second part 22*b* extends at a second, smaller angle to the face 18'.

The leg 20 is hingedly connected at one end of its first part 22*a* to the opposite face of the engagement wall 16', so as to be moveable relative to the door engagement member 12' between a bracing position (as shown) and a released position. In the bracing position the leg 20 is spaced from the engagement wall 16' and in the released position the foot 26' is located generally adjacent to the engagement wall 16'.

The adjustable length section 24' of leg 20 is embodied as a threaded bolt located in a threaded aperture within the second part 22*b*. The adjustable length section 24' includes a wing nut 28' for turning the threaded bolt into or out of the fixed length section 22 to shorten or lengthen the adjustable length section 24'. The foot 26' is provided with a pad 32' of non-slip material to provide additional resistance to force applied to the door brace 20'.

In use, with the door brace 10' in its released condition the bottom flange 14' is underneath the door 34' and the door brace 10' is pushed towards the door 34' until the face 18' of the engagement wall 16' is located against part of one side of the door 34'. The leg 20 is then moved from the released to the bracing position, whereby the length of the adjustable length section 24' is increased by turning the wing-nut 28', and the non-slip pad 32' on the foot 26' contacts the floor 36'. In this position a force applied against the door 34 on the side opposite to the one on which the door brace 10' is located is transferred into the door brace 10', and a downwards component of the force is exerted downwardly through the leg 20' and the foot 26' into the floor 36'. Any external force on the door 34' increases the strength of the engagement of the door brace 10' between the door 34' and the floor 36'.

Applicant, in its co-pending parent '746 application, described two (2) conventional door locking apparatuses, as shown in FIGS. 3 and 4 (DC-powered) and in FIGS. 5 and 6 (AC-powered). Referring to FIGS. 3 and 4, in the DC-powered embodiment, Applicant described a removable, remotely-controlled door locking apparatus, or more particularly an apparatus 100 for providing resistance to forced entry through a door. Apparatus 100 includes a housing 110 enclosing various mechanical and electrical components, and is designed to be removably fixed to a portion of a door 105. As shown attached to the door 105, the bottom of the apparatus 100 is not in contact with a floor surface 107, there is a space.

The housing 110 includes an interior metal backing 112, a pair of interior upper support ribs 114, a pair of lower, spaced interior support ribs 117, an access cover 116 on a sloping front facing 113 for access to various components therein. Housing 110 includes a bottom horizontal flange 115 that is designed so as to be located under a bottom edge of the door 105, in a space between the door bottom edge and the floor surface 107. This facilitates orienting and securing a rear face 111 of housing 110 flush against the door 105.

Additionally, apparatus 100 includes attachment means embodied as one or more suction cups 195 to removably attach the rear face 111 of the housing 110 to a portion of the opposite-facing door 105. As shown in FIG. 4, suction cup 195 may include a flexible elastomeric barb 196 that friction fit attaches to backing 112 at hole 197.

Within housing 110, a DC-powered linear actuator 150 is adapted to actuate a movable foot 170. The actuator 150 comprises a DC motor 153, the lead screw (not shown, within screw housing 154) and a traveler rod 155, which has a proximal end connected to a nut traveling on the lead screw (not shown, within a screw housing 154) and a distal end attached to foot 170 between posts 171 thereof.

An upper end 151 of the actuator 150 is fixed between the upper support ribs 114 via a metal pin 118 such as a cotter pin, and the actuator lower end 152 is connected to a horizontal connecting rod 160 attached at one end via pin 161 between lower support ribs 117, and at its other end to the screw housing 154, which extends through aperture 162, The movable foot 170 is attached to a lower end 152 of the actuator 150. Foot 170 includes posts 171 connected to the actuator lower end 152 by a pair of metal mounting pins 172, which also serve to secure an end of a metal horizontal connecting rod 160. Foot 170 includes an elastomeric bottom pad 173 that, with the foot 170 in the lock state, provides a frictional surface against the floor surface 107 to facilitate maintaining the door 105 in place.

As described in the '746 application, for actuator 150 the DC motor 153 is configured to receive a current signal from an electronics module 180 via a power source 130 within the housing 110, to either extend of retract foot 170. Namely, based on the signal, a lead screw (within the screw housing 154) rotatable in two directions under control of the DC motor 153 translates rotary motion thereof to a linear displacement, the lead screw having a continuous helical thread on its circumference running along a length thereof, and a nut (not shown) which travels on the threads of the lead screw but does not rotate with the lead screw, the nut having corresponding helical threads threaded on the lead screw. The nut is adapted to be driven along the threads of the lead screw as the lead screw rotates in a first direction so that the traveler rod 155 and attached foot 170 extend (upon a lock state signal being received), or is adapted to be driven as the lead screw rotates in a second direction so that the traveler rod 155 and attached foot 170 retract (upon an unlock state signal being received). Accordingly, in the locked state, any external force on the door 105 increases the strength of the engagement of the apparatus 100 between the door 105 and the floor 107.

As described in detail in the '746 application, movement of the foot 170 by the DC-powered actuator 150 is based on a remote, wireless signal sent from a smart device (not shown, but embodied as any of a cell phone, smart pad, key fob and the like) and received by an electronics module 180 (configured in an example as a printed circuit board assembly (PCBA)) that is configured to communicate wirelessly with the remote smart device in order to control the powered actuator 150.

Housing 110 includes indicator lamps thereon such as LEDs for example, here shown as a lamp 120 that when illuminated may indicate that the apparatus 100 is paired (via a short wave radio signal such as BLUETOOTH, Wi-Fi, etc.) with the smart device, or actively in a charging mode, fully charged, and/or also as an indication of an intruder alert. Another lamp 121 can represent a battery level low or battery charging indicator, and/or also be an indication of an intruder alert. Housing 110 includes a charging port 181 adapted for receiving external DC power thereto from a cable, such as a cable connected to DC wall power.

The indicator lamps 120, 121, actuator 150 and electronics module 180 are powered by a power supply 130, such as one or more alkaline or rechargeable batteries 132. A user may electrically connect the power source 130 to other electrical components therein by simply pressing a power (on/off) button 131, which extends through aperture 123 in housing 110. The on/off button 131 when pressed electrically connects the electronics module 180 to battery power via power source 130 thereto via a tach switch 182.

FIGS. 5 and 6 illustrate another of Applicant's conventional door locking apparatuses described in the '746 application; this apparatus 100' being AC-powered. Here, apparatus 100' is removably fixed to door 105 and includes within its housing 110' an AC motor 150' configured to actuate a movable foot 170'.

Here, movement of the foot 170' to secure door 105 is powered by the AC motor 150', the armature of which is energized via a power source 130' based on a wireless signal received from a smart device (not shown) by the electronics module, referred to as PCBA 180'. A wireless radio in a microcontroller (MCU) mounted on PCBA 180' is capable of acting as a transceiver, implementing protocols associated with any of the NFC, WIFI, 3G/4G/5G, GSM, Bluetooth and ZigBee standards, as well as for other known or developing wireless communication protocols, among various other communications standards. Furthermore, the MCU in PCBA 180' may be used to wirelessly transmit status notifications to the smart device.

The AC motor 150' is thus electrically connected to a PCBA 180' and configured to power a gearbox 154' (reduction gears with cam shaft) which rotates a horizontal lifting rod 155' that is fixedly connected to spaced plates 156. The plates 156 in turn are connected to the pivotable foot 170'.

The plates 156 move with clockwise or counterclockwise rotation of the rod 155' (dependent on rotary motion direction of AC motor 150') to either raise foot 170' from (or lower it to) the floor surface 107 so that pad 173 comes into frictional contact therewith. Somewhat similar to Applicant's DC-powered embodiment in the '746 application, upon the MCU in PCBA 180' receiving a wireless signal (e.g., locking command) from a smart device, the armature of AC motor 150 energizes to impart or rotary motion to gearing in gearbox 154' so as to rotate lifting rod 155' in a counterclockwise direction. This lowers foot 170' toward the floor surface 107, as described previously. The floor 107 exerts a counterforce which causes apparatus 100' to act as a wedge between the door 105 and floor 107, effectively securing door 105 in place. Alternatively, apparatus 100' may be employed to lock open door 105.

Conversely, upon the microcontroller in PCBA 180' receiving a different wireless control signal (e.g., unlocking command) from smart device 140, the armature of AC motor 150 energizes to impart or rotary motion to gearing in gearbox 154' so as to rotate lifting rod 155' in a clockwise direction. This raises foot 170 away from the floor surface 107.

Power to the electrical components therein from the power source 130' is provided by a manual on/off switch 125 on housing 110'. With switch 125 on, the power source 130', such as an AC battery pack of alkaline or rechargeable cells 132, powers each of the AC motor 150', PCBA 180' and lamps 121', 122'. Alternatively, AC wall power may be used in a wired configuration via a suitable adapter. Lamp 121' indicates a locked (lamp 121' green illuminated) or unlocked (lamp 121' red illuminated) state. There is also lamp 122' which indicates a battery fully charged (lamp 122' green illuminated) or battery power low (lamp 122' red illuminated) state.

SUMMARY

An example embodiment of the present invention is directed to a removable, remotely-controlled door locking apparatus. The apparatus includes a rear plate for attachment against a surface of a door, a removable cover for enclosing components on the rear plate, and a telescoping arm assembly connected at one end to the rear plate and extendible upward so that a second end of the assembly attaches to a door knob of the door. The apparatus further includes a DC-powered linear actuator enclosed within the removable cover and connected to the rear plate, at least one electronics module attached to the rear plate and configured to communicate wirelessly, and a foot attached to a lower end of the DC-powered linear actuator, the foot configured under actuator control to be extended in a lock state against a floor surface to secure the door or retracted in an unlock state, based on a wireless signal received from a remote smart device to control the DC-powered linear actuator. The apparatus further includes a pressure sensor attached to the rear plate for, upon receiving a control signal based on a user of the remote smart device placing the remotely-controlled door locking apparatus in a lock state with a wireless command signal transmitted to the at least one electronics module, sensing a movement condition of the door only from its locked state such that the at least one electronics module generates an alarm signal locally at the door, and issuing a wireless alert message that is transmitted for display on the remote smart device of the user.

Another example embodiment is directed to a removable, remotely-controlled door locking apparatus which includes a rear plate having a plurality of electronic and mechanical components fixed thereon, a cover removably attached to the rear plate to enclose the plurality of electronic and mechanical components, and a DC-powered linear actuator enclosed within the cover and connected to the rear plate, the DC-powered linear actuator including a piston rod terminating in a foot, the DC-powered linear actuator either extending or retracting the piston rod and foot in response to a wireless signal transmitted from a handheld smart device to the apparatus. The apparatus further includes a telescoping arm assembly connected at a lower end to the rear plate and the DC-powered linear actuator, and extendible upward so that an upper end of the assembly attaches to a door knob of the door so as to facilitate stabilizing the apparatus with the rear plate flush against a door surface. The telescoping arm assembly further including a spring-biased hook, the spring-biased hook attached at its lower end to the upper end of the telescoping arm assembly via a single pin, such that the spring-biased hook is rotatable by a user in a direction opposite to a direction of spring pressure applied thereto so as to latch with spring force to the door knob, and a spring loaded, door bottom holding lip attached to the rear plate that engages an underside of the door to assist, in conjunction with the telescoping arm assembly, securing the rear plate against the door surface.

Another example embodiment is directed to a remotely-controlled door locking apparatus adapted to be removably secured against a door surface. The apparatus includes a rear plate adapted to be removably secured against the door surface, a removable cover attached to the rear plate, and a control board attached to the rear plate for communicating wirelessly with a remote smart device and configured to send control signals to other electronic devices on the rear plate. The apparatus also includes an actuation control board which, based on a control signal wirelessly received via the control board from the remote smart device, sends a motor control signal to a DC-powered linear actuator so as to either extend a foot attached to a lower end of a piston of the actuator to seat the foot against a floor surface, or retract the piston and foot to disengage the floor surface. The control board further includes an undervoltage circuit that, upon sensing a low voltage condition, sends a control signal via the actuation control board to de-energize the actuator and retract the piston with foot from the floor surface.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figure 2:
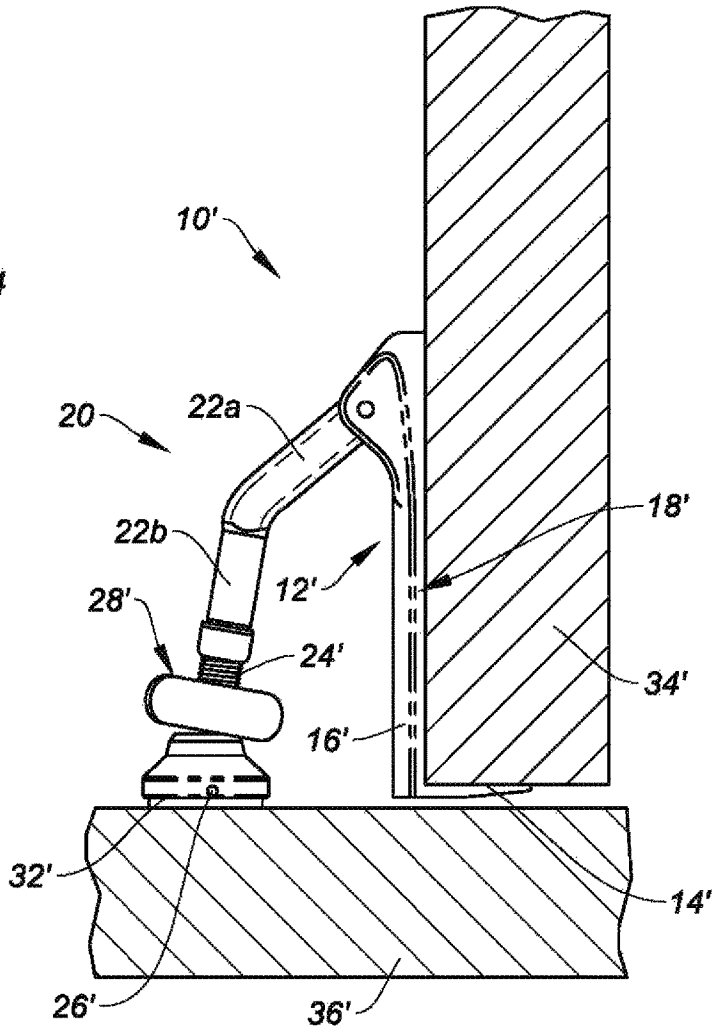
FIG. 2 (Prior Art)
FIG. 2 shows a side view of another prior art door brace.
Figure 1:
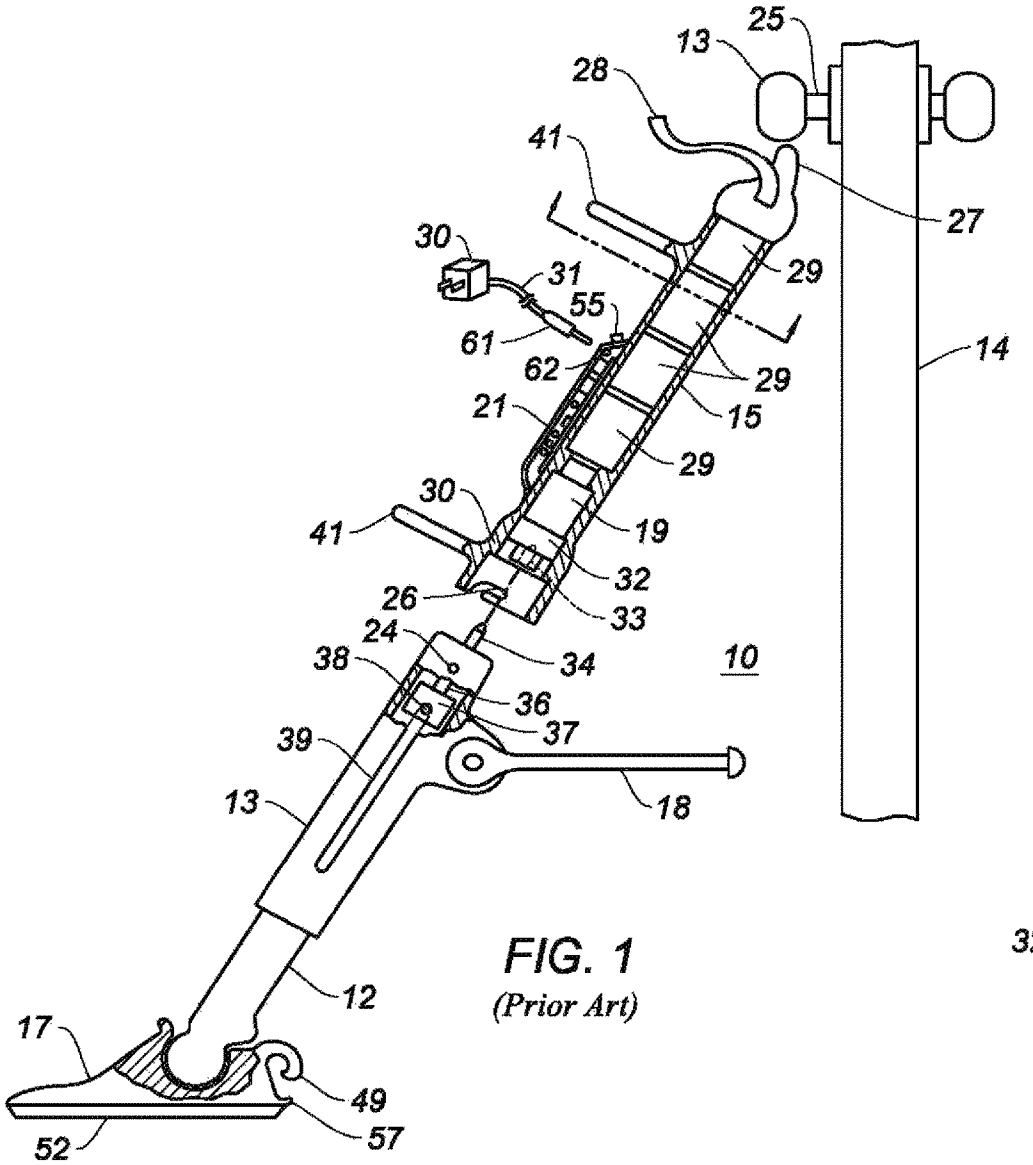
FIG. 1 (Prior Art)
FIG. 1 shows a side view of a prior art door brace.
Figure 4:
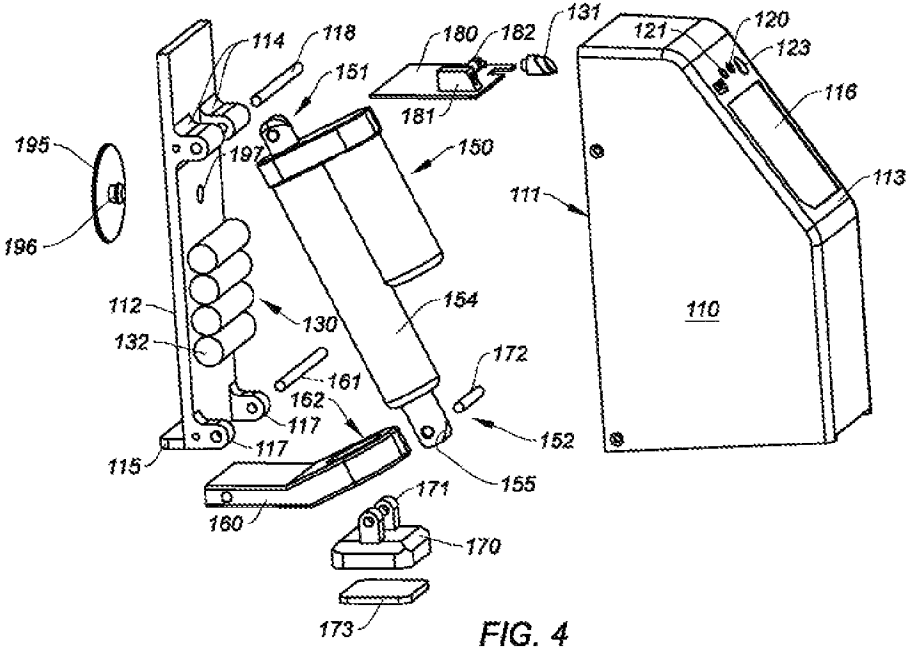
FIG. 4 (Conventional Art)
FIG. 4 is an exploded parts view of the apparatus of FIG. 3 to illustrate selected internal components thereof in more detail.
Figure 3:
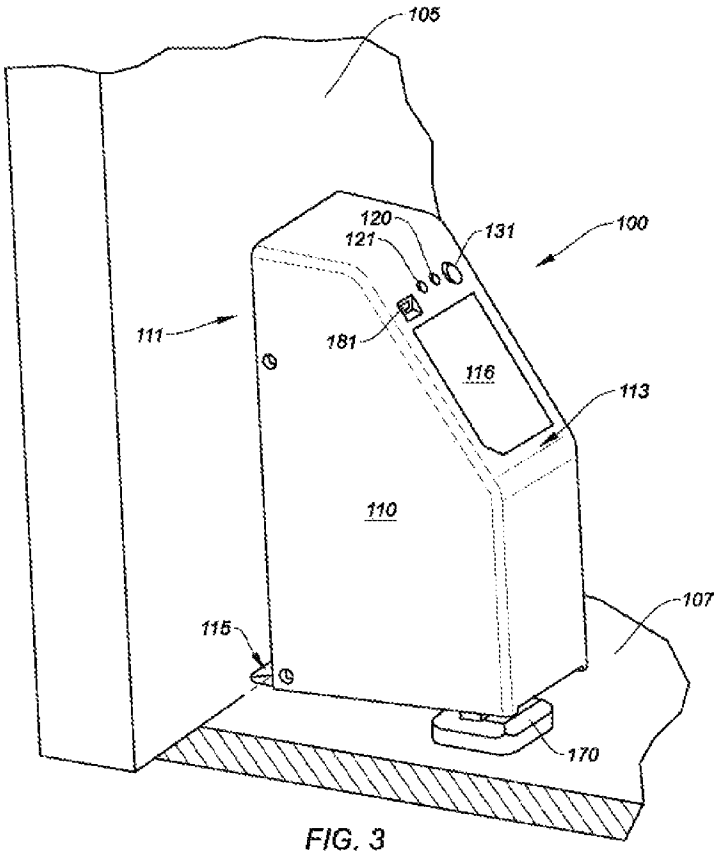
FIG. 3 (Conventional Art)
FIG. 3 is a perspective view of a conventional removable, remotely-controlled door locking apparatus.
Figure 6:
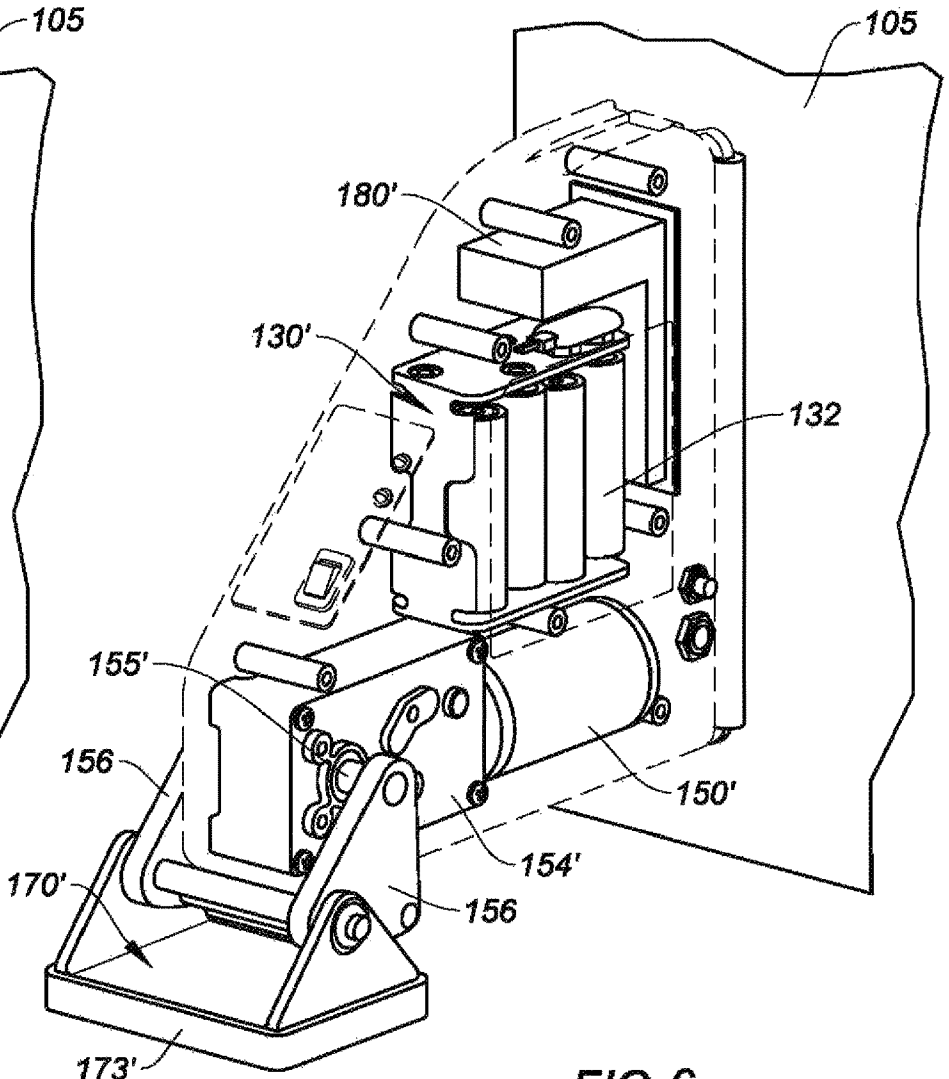
FIG. 6 (Conventional Art)
FIG. 6 is a perspective transparent view of the apparatus of FIG. 75 to illustrate selected internal components thereof in more detail.
Figure 5:
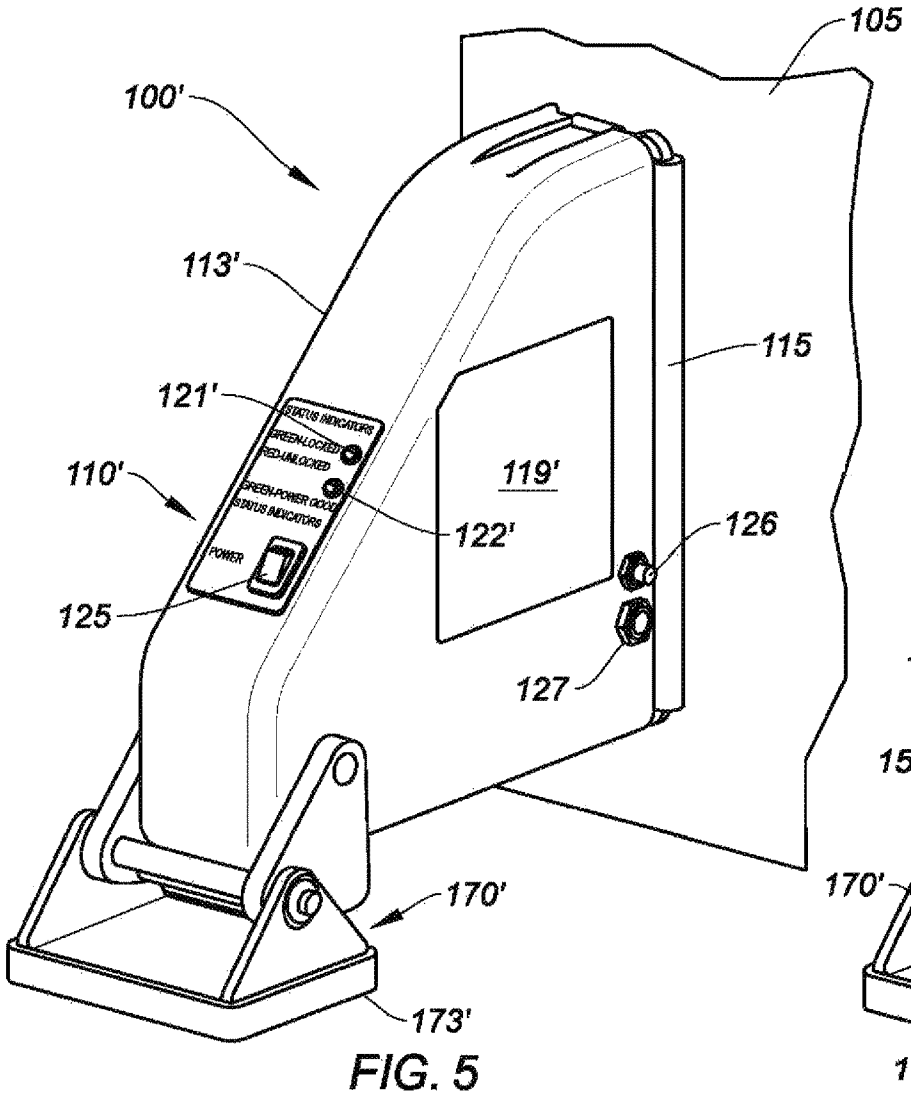
FIG. 5 (Conventional Art)
FIG. 5 is a perspective view of another conventional removable, remotely-controlled door locking apparatus.
Figure 7:
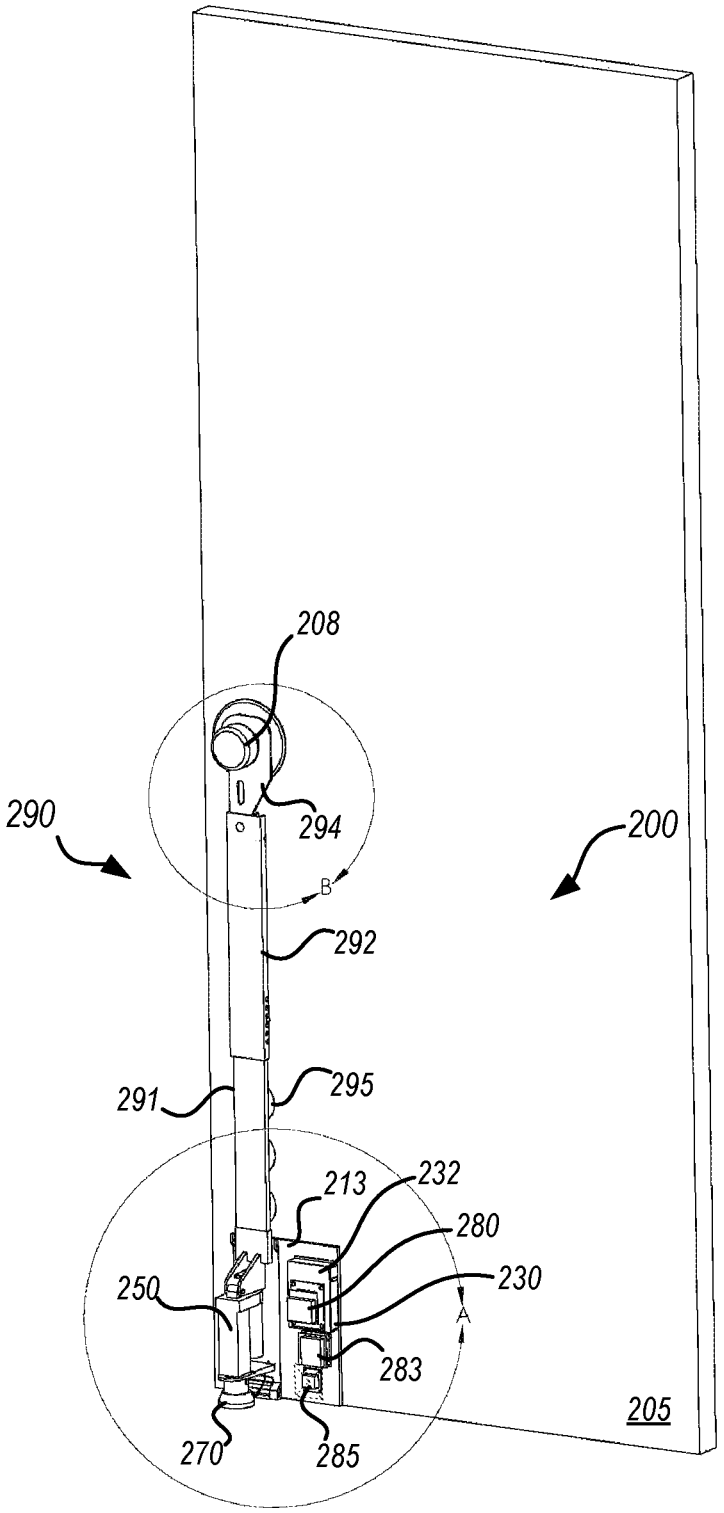
FIG. 7 is a perspective view of a removable, remotely-controlled door locking apparatus installed on a door with the cover removed.
Figure 8:
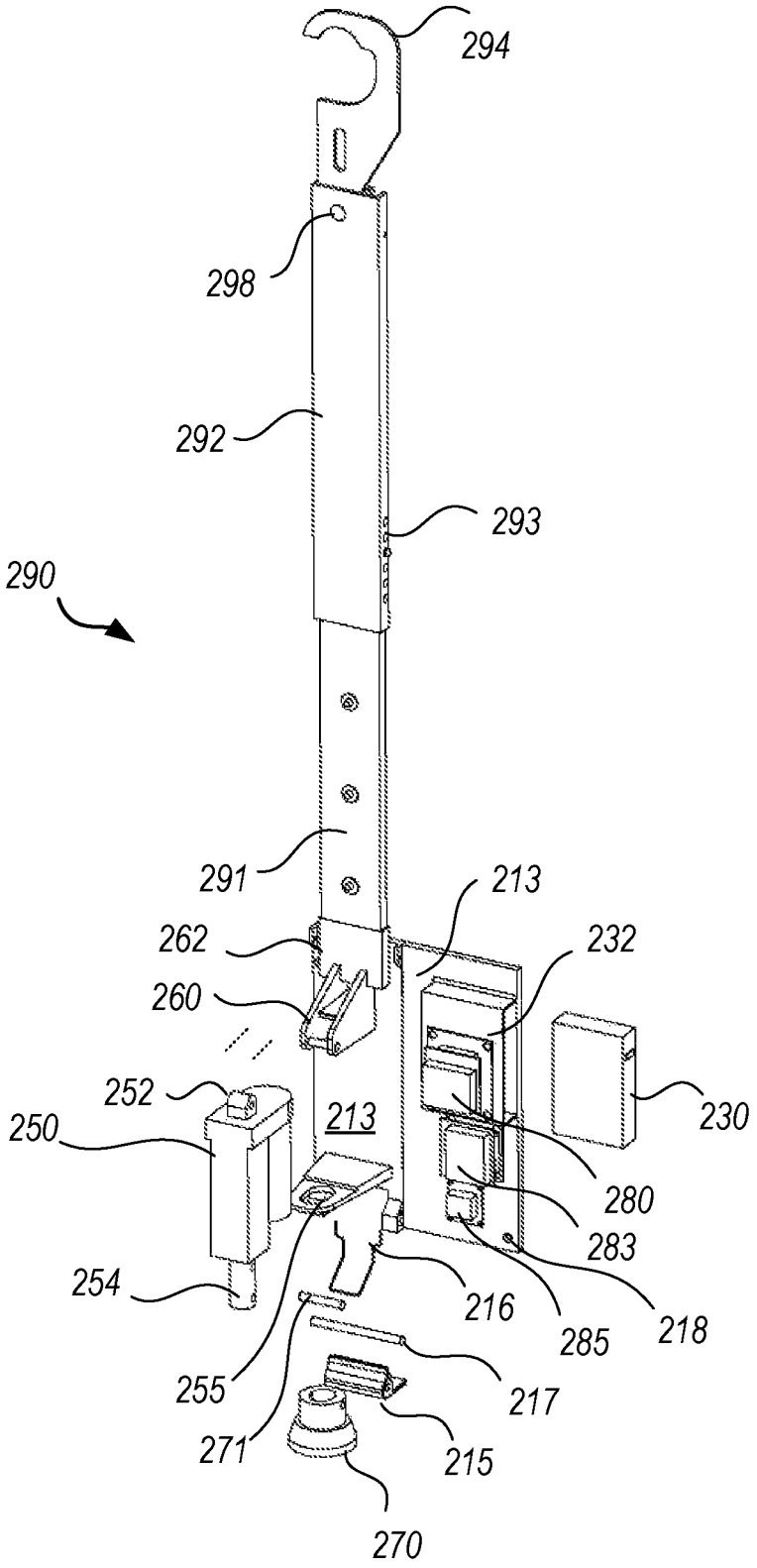
FIG. 8 is an enlargement of circle A in FIG. 7 to show constituent components of the internals of the apparatus in more detail.

In the following description, certain specific details are set forth in order to provide a thorough understanding of various example embodiments of the disclosure. However, one skilled in the art will understand that the disclosure may be practiced without these specific details. In other instances, well-known structures associated with manufacturing techniques have not been described in detail to avoid unnecessarily obscuring the descriptions of the example embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one example embodiment" or "an embodiment" means that a particular feature, structure or characteristic described in connection with the embodiment is included in at least one embodiment. Thus, the appearances of the phrases "in one example embodiment" or "in an embodiment" in various places throughout this specification are not necessarily all referring to the same embodiment. Further, the particular features, structures or characteristics may be combined in any suitable manner in one or more example embodiments.

As used in this specification and the appended claims, the singular forms "a," "an," and "the" include plural referents unless the content clearly dictates otherwise. The term "or" is generally employed in its sense including "and/or" unless the content clearly dictates otherwise.

As used in the specification and appended claims, the terms "correspond," "corresponds," and "corresponding" are intended to describe a ratio of or a similarity between referenced objects. The use of "correspond" or one of its forms should not be construed to mean the exact shape or size. In the drawings, identical reference numbers identify similar elements or acts. The size and relative positions of elements in the drawings are not necessarily drawn to scale.

As used in the specification and appended claims, the term "smart device", "remote smart device" or "handheld smart device" is intended to refer to an electronic device, generally connected to other devices or networks via different wireless protocols such as Bluetooth, NFC, Wi-Fi, 3G, 4G, 5G, WiMAX, etc., that can operate to some extent interactively and autonomously. Example smart devices may include but are not limited to mobile device smartphones such as ANDROID®, BLACKBERRY® and IPHONE®-based systems, phablets and tablets, smartwatches, smart bands, and smart key chains. The term smart device may also refer to a ubiquitous computing device, e.g., a device that exhibits some properties of ubiquitous computing including, although not necessarily, artificial intelligence.

Hereafter, the example embodiment is directed to a removable, remotely-controlled door locking apparatus 200. Referring now to FIGS. 7-15, apparatus 200 includes a rear plate 213 for attachment against a surface of a door 205, and a removable cover 210 for enclosing selected electronic and mechanical components on the rear plate 213. A telescoping arm assembly 290 is connected at one end to the rear plate 213 and to an upper bracket 260 that supports a DC-powered linear actuator 250 enclosed within cover 210 against the rear plate 213. The telescoping arm assembly 290 is extendible upward so that a doorknob hook 294 at the other end of the assembly 290 attaches to a door knob 208 of the door 205.

One or more electronics modules, namely a control board 280, an actuator control board 283, and a pressure sensor 285 are affixed on rear plate 213. Control board 280, which is the brain of the electronics modules, includes transceiver circuitry that enables wireless short-range RF communications with a remote smart device 240 (see FIG. 15, for example). In another example, control board 280 and the remote smart device 240 are each configured to be connected to a network, and the wireless signal is a Wi-Fi communications signal utilizing standard Wi-Fi protocols.

The actuator 250 includes a movable piston 254 which terminates at a lower end in a foot 270, which is attached to the piston 254 via a lock screw 271 and the like. A fixed upper piston casing 252 protrudes from the top of actuator 250 and is captured by a pin 261 so as to be secured to upper bracket 260 which supports the upper end of actuator 250 on rear plate 213. A lower bracket 255 connected to rear plate 213 supports the lower end of actuator 250. The piston 254 with foot 270 is configured under actuator 250 control to be extended in a lock state against a floor surface to secure the door or retracted in an unlock state, based on a wireless signal received from by control board 280 from the remote smart device 240 to control the actuator 250. This is described in further detail below.

Cover 210 is attached to rear plate 213 at cutout 214, which includes ball detents (not shown) which are captured in apertures within flanges 264 attached to rear plate 213. This permits cover 210 to be rotated up and down for internal access. The cutout 214 also provides clearance for a lower arm end cap 262 of a telescoping arm assembly 290, explained in further detail hereafter. Cover 210 may be constructed primarily from lightweight moldable plastic materials such as moldable plastic, e.g., as a single or multiple parts formed by an injection molding process using a high impact plastic such as Acrylonitrile Butadiene Styrene (ABS). ABS is an easily machined, tough, low cost rigid thermoplastic material with high impact strength, and may be a desirable material for turning, drilling, milling, sawing, die-cutting, shearing, etc. Virgin ABS may be mixed with a plastic regrind of ABS or another lightweight, durable plastic material. ABS is merely an example material, equivalent materials may include various thermoplastic and thermoset materials, such as talc-filled polypropylene, high strength polycarbonates such as GE Lexan®, or blended plastics.

There are many known injection molding machines for forming plastic injection molds, other plastic molding processes such as vacuum forming may be used. Alternatively, cover 210 may be formed using a metal casting process such as sand casting, die casting, or investment casting, for example.

Figure 9:
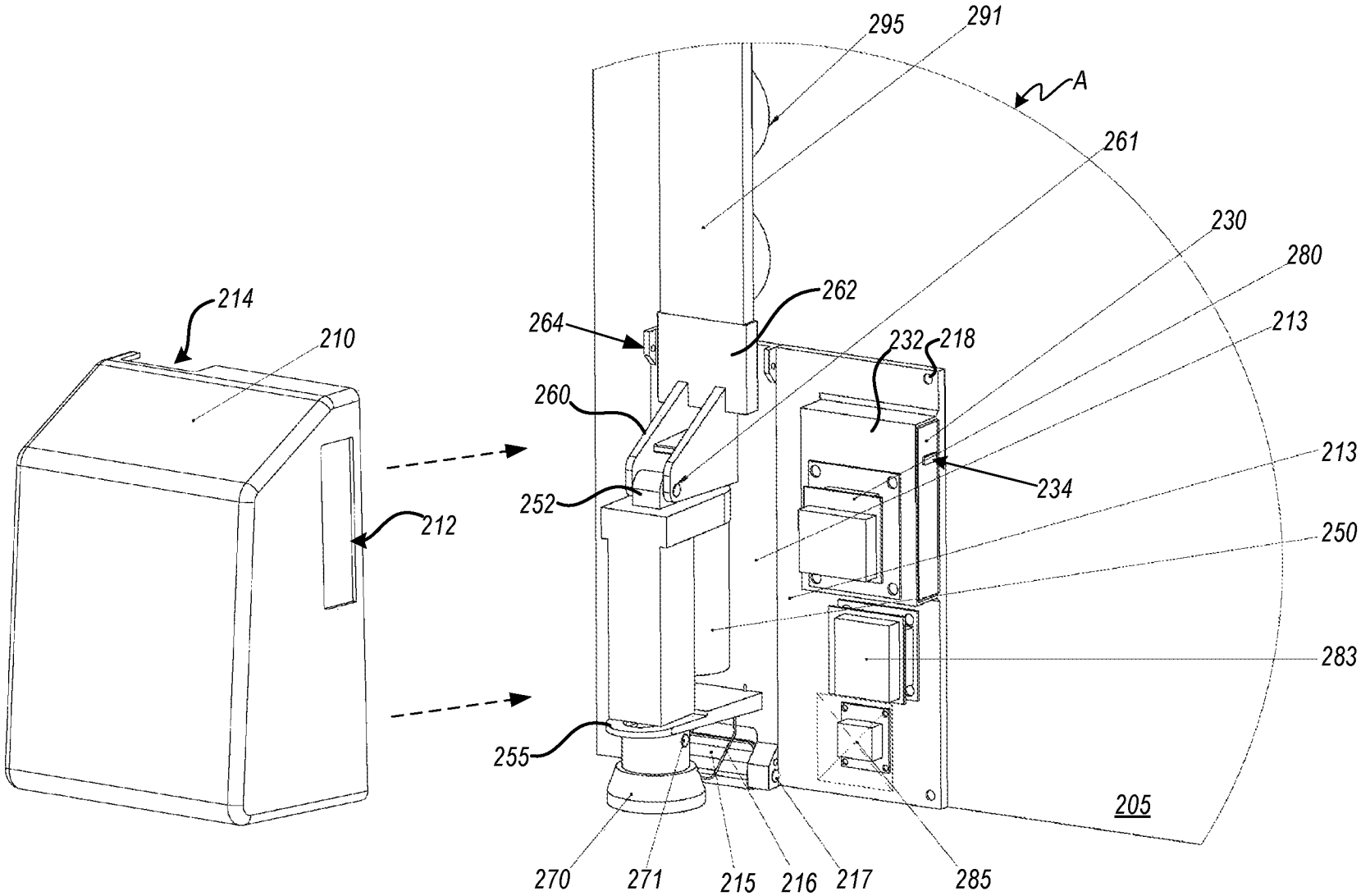
FIG. 9 is an enlargement of circle B in FIG. 7 to show constituent components of a telescoping arm assembly of the apparatus in more detail.
Figure 11:
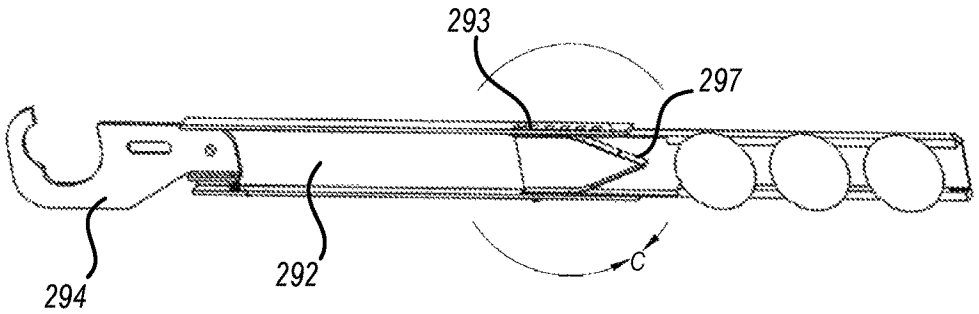
FIG. 11 is an enlarged portional view of part of the telescoping arm assembly to show connective engagements between upper and lower arms and attachment means to the door surface in more detail.
Figure 12:
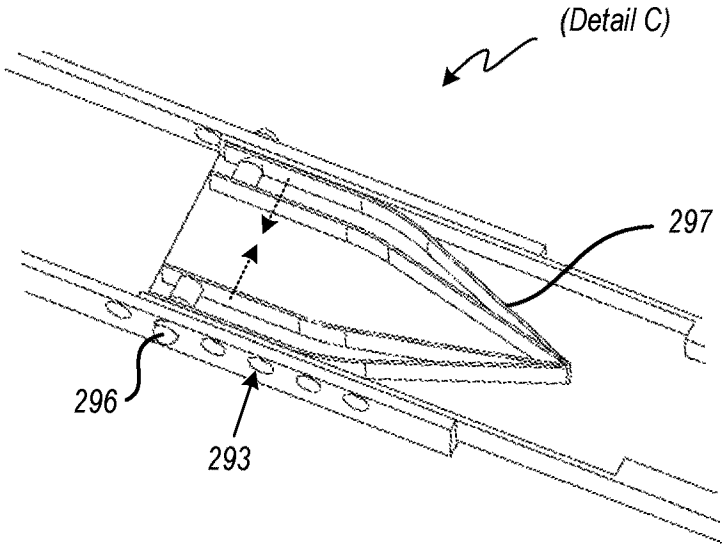
FIG. 12 is an enlargement of detail C in FIG. 11 to show connective components of the telescoping arm assembly in more detail.
Figure 10:
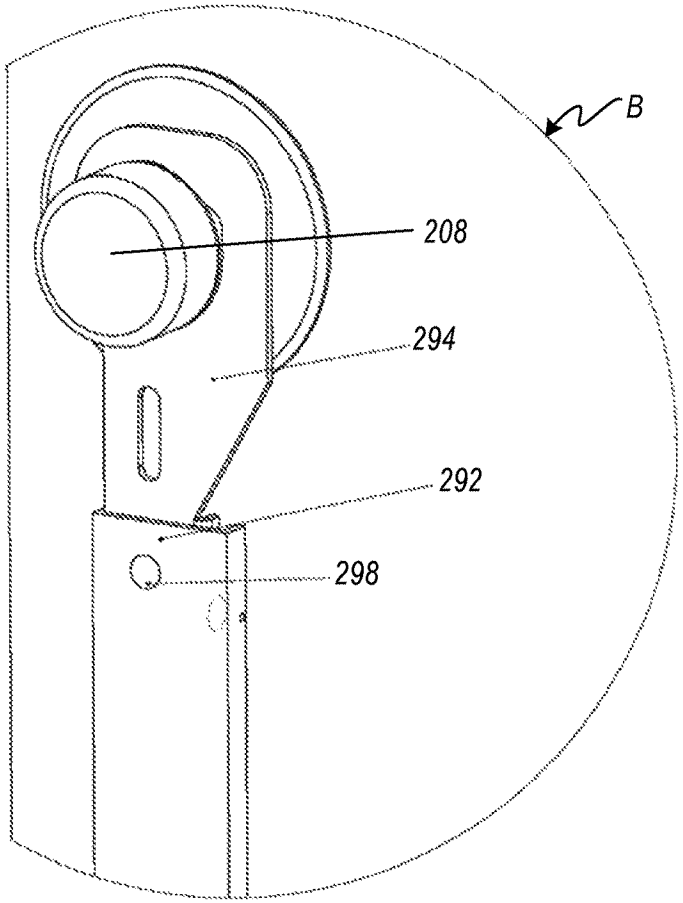
FIG. 10 is an enlarged portional view of an upper end of the telescoping arm assembly to connection of the doorknob hook to a doorknob in more detail.

The electronic modules of apparatus 200 may best be shown in FIG. 9. Each of the electronics modules are each attached to rear plate 213 and may include a control printed circuit board (PCB) 280 ("control board 280"), an actuation control board 283, and a pressure sensor 285. In general, the control board 280 communicates wirelessly with the remote smart device 240 and is configured to send control signals to other electronic devices on the rear plate 213. The actuation control board 283 in general controls the actuator 250 via a motor control signal, based on a control signal received via the control board 280 from the remote smart device 240. The pressure sensor 285 is adapted to sense a movement condition of the door 205, so as to generate an audible alarm and signal that is transmitted wirelessly via control board 280 to the handheld smart device 240 for display to a user of the handheld smart device 240. Although not shown, control board 280 includes an undervoltage circuit that continually senses battery voltage. Upon sensing a low voltage condition, it sends a control signal via the actuation control board 283 to de-energize the actuator 250 and retract the piston 254 with foot 270 from the floor surface. This low voltage limit may be set as desired, such as 10V, 8V, etc. Further, in lieu of an external AC charger to charge battery pack 230, control board 280 may also include an internal charger (not shown) for charging one or more rechargeable batteries of battery pack 230.

In one example, each of the control board 280 and actuation control board 283 may be embodied as a microcontroller (MCU)-on-chip, with control board 280 being capable of wireless short-range RF communications with a smart device 240 using BLUETOOTH protocols. As is well known, a BLUETOOTH device works by using short-range RF waves (two devices communicating typically up to about 30 feet apart) instead of wires or cables to connect with a smart device.

In one example, a commercially-available BLUETOOTH-capable module or chip usable for control board 280 may be an ARDUINO UNO REV3 Microcontroller. In another example, control board 280 may be embodied as a 2.4-GHz BLUETOOTH, low energy System-on-Chip by TEXAS INSTRUMENTS®, part numbers CC2540F128 or CC2540F256, configured for both ANDROID® and IOS® communications operations, as is known.

In another example, wireless fidelity (Wi-Fi) communications may be established between control board 280 and smart device 240 via various standard Wi-Fi protocols, with both being connected to a network. This configuration would require a Wi-Fi capable controller. Current Wi-Fi systems support a peak physical-layer data rate of 54 Mbps and typically provide indoor coverage over a distance of about 100 feet. Wi-Fi is based on the IEEE 802.11 family of standards (e.g., 802.11a for wireless Local Area Networks (LANs) with data transfer rates up to 54 Mbps in the 5-GHz band employing an orthogonal frequency division multiplexing (OFDM) encoding scheme as opposed to either the frequency-hopping spread spectrum (FHSS) or direct-sequence spread spectrum (DSSS); 802.11b, for wireless LANs with rates up to 11 Mbps transmission (with a fallback to 5.5, 2 and 1 Mbps depending on strength of signal) in the 2.4-GHz band using only DSSS; and 802.11g for wireless LANs with rates 20+ Mbps in the 2.4-GHz band). Accordingly, in a specific Wi-Fi configuration, control board 280 may be embodied as, in one example, a user-dedicated MCU Power Wi-Fi battery-operated chip, such as TEXAS INSTRUMENTS' CC3200 wireless MCU module.

In an example, a commercially-available actuator board 283 for use in apparatus 200 may be a POLOLU TReX Dual Motor Controller, part number DMC01. In an example, a commercially-available pressure sensor 285 may be a DIGIKEY (Reseller), 223-1528-ND, FX1901-0001-0025-L Sensor Tense Load Cell. Optionally, an audible alarm sensor (actuating upon the movement sensed by pressure sensor 285) may also be provided in apparatus 200, although not shown for purposes of brevity. A commercially available part for the audible sensor may be a DIGIKEY (Reseller) 445-5229-1-ND, PS1240P02CT3 audio piezo transducer.

As is well known in the art, electro-mechanical linear actuators convert rotary motion of a DC motor (such as a permanent magnet, stepped or brushless DC motor) into linear displacement. The electric motor is mechanically connected to rotate a lead screw, such as a ball-bearing lead screw for example. The lead screw has a continuous helical thread machined on its circumference running along the length (similar to the thread on a bolt). Threaded onto the lead screw is a lead nut or ball nut with corresponding helical threads.

A commercial example for the DC-powered linear actuator 250 may be an ECO-WORTHY 12V 2-Inch Stroke Linear Actuator. In actuator 250 operation (in general), current in the armature of the DC motor (applied based on a motor control signal from the actuator board 283) causes rotary motion of its motor. As the lead screw is rotated by the DC motor, the nut will be driven along the threads. The direction of motion of the nut depends on the direction of rotation of the lead screw. By connecting an upper end of the movable piston 254 to the nut, the motion of the lead screw is converted into a usable linear displacement, e.g. the piston 254 with foot 270 attached thereto either is retracted as the lead screw rotates in a first direction based on motor rotation (i.e., with apparatus 200 in the unlock state), or the piston 254 with foot 270 moves downward with the nut to the lock state as the lead screw rotates in a second opposite direction under DC motor control. Linear actuators are often supplied with limit switches, such as electro-mechanical, magnetic proximity and rotary cam. These limit switches are designed to control the length of the stroke of the piston 254 for a particular application.

Although the example embodiments are not so limited, typical specifications for these linear actuators include any of a DC Mini permanent magnet motor, brushless DC motor, or stepper motor configured to handle a max load of at least 100 N, in an example range between about 100 to 2500 N, configured to generate a turning speed from about 5 mm/s to 80 mm/s, and achieving a stroke of about between 20-1100 mm with built-in limit switches.

Figure 17:
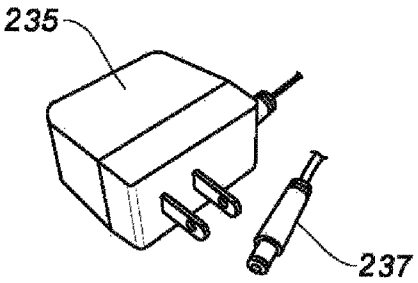
FIG. 17 is an adapter for powering the apparatus of FIG. 7 or recharging batteries therein.

The power supply for apparatus 200 to power the electronics and DC motor of actuator 250 may be in one example a battery pack 230 comprising one or more alkaline batteries or rechargeable batteries, which seats into a battery compartment 232 affixed to rear plate 213. A well-known push-push button 234 (accessible through a cutout 212 in cover 210) may be used to locking engage and disengage pack 230 into compartment 232. In a further alternative, the power supply could be solar-powered, where solar cells can be charged by ambient light or by a combination of a rechargeable battery with solar cells to charge the battery pack 230. Alternatively, battery pack 230 may be charged remotely via an external charger with wall power, as shown in FIG. 17.

In an example, it is desirable that apparatus 200 be removeably attachable against the surface of door 250 with minimal, if any, marring of the door 205. Although rear plate 213 is provided with corner holes 218 to receive fasteners for permanent affixation of rear plate 213 to door, the Applicant has devised a much less intrusive attachment means for apparatus 200. Namely, this may be accomplished by employing a combination of a telescoping arm assembly 290 and a spring loaded, door bottom holding lip 215 that engages an underside of the door 205 to assist in securing the apparatus 200 thereto.

For the spring loaded, door bottom holding lip 215, reference is made to FIG. 9. Namely, there is provided a pivotable, spring 216-biased, door bottom holding lip 215 that is attached to a lower portion of the rear plate 213. The door bottom holding lip 215 is rotatable about a pivot bar 217 against spring 216 pressure so as to enable lip 215 to engage a slit or opening provided between a bottom of the door and a door stop or floor surface, so as to facilitate securing the apparatus 200 against the door 205 surface in conjunction with the telescoping arm assembly 290 explained hereafter.

Figure 14:
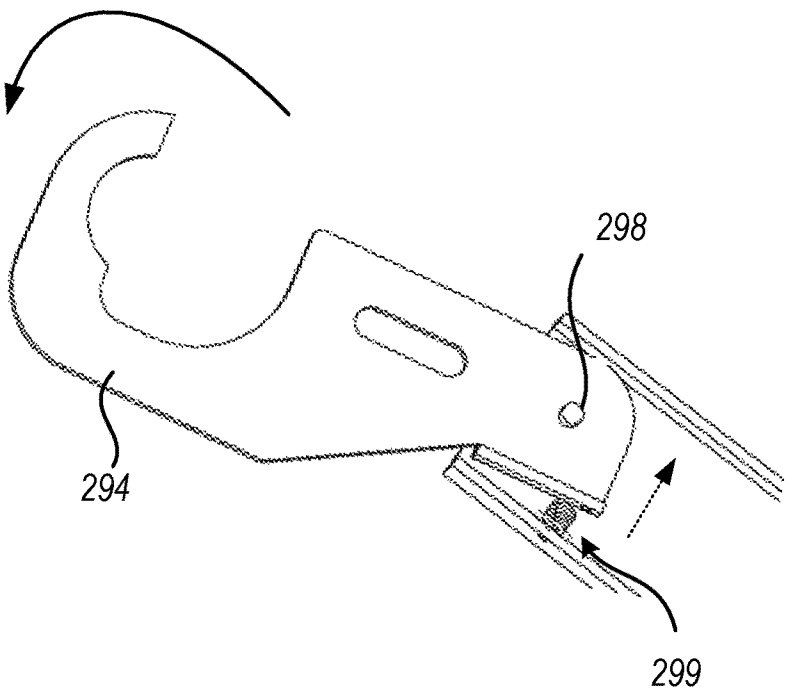
FIG. 14 is an enlarged portional view of the upper arm and doorknob hook of the telescoping arm assembly to show operation of the hook against spring pressure in more detail.
Figure 13:
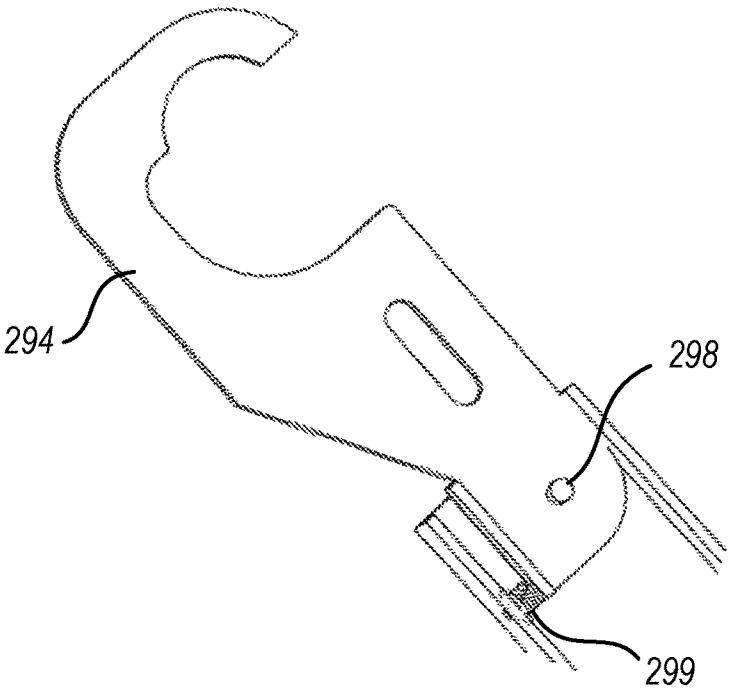
FIG. 13 is an enlarged portional view of the upper arm and doorknob hook of the telescoping arm assembly.

Referring now to FIGS. 10-14, the telescoping arm assembly 290 is described in further detail. Assembly 290 includes a fixed lower arm 291 having its bottom end contained within a lower arm end cap 262 that is attached to rear plate 213. Lower arm 291 includes a plurality of adjacent and spaced adjustment holes 293 which are designed to capture detents 296 at the end of a compressible center spring 297 (see FIG. 12) in order lengthen or shorten the length of the telescoping arm assembly 290 by adjusting movable upper arm 292, depending on the distance to the doorknob 208. At the end of upper arm 292 is provided a pivotable doorknob hook 294, which is attached by way of a lock pin 298 to the upper arm 292. FIGS. 13 and 14 illustrate the pivoting nature of hook 294 by way of the use of spring 299, which expands as hook 294 is rotate counterclockwise in order to provide a spring-biased capture of a doorknob 208.

Assembly 290 also includes attachment means 295 affixed between part of the arm assembly 290 (lower arm 291) and a surface of the door 205. In this example, these are illustrated as a plurality of suction cups 295. This connection provides additional stability for apparatus 200 against the surface of door 205, and with the bottom lip 215 offers a non-mark means of attaching apparatus to door 205. In an alternative, suction cups 295 could be substituted with hook and loop material fasteners, and/or a light adhesive to secure telescoping arm assembly 290 of the apparatus 200 to a surface of the door 205.

Figure 15:
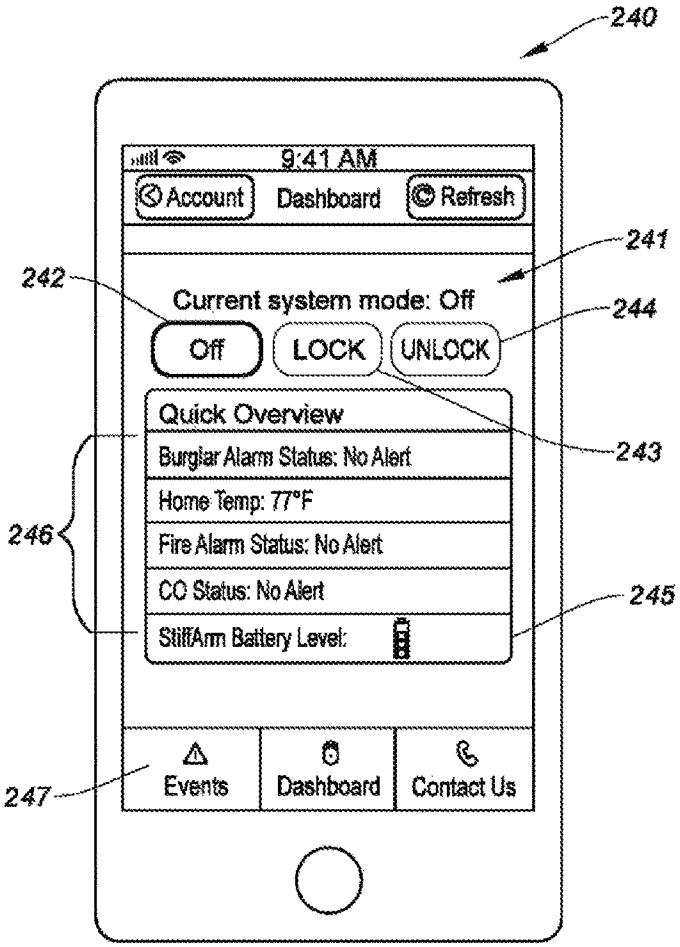
FIG. 15 is a front view of a smart phone illustrates an exemplary display for an application to control the apparatus shown in FIGS. 7-9 remotely.

FIG. 15 is a front view of a smart phone to illustrate an exemplary display for an application to control apparatus 200 remotely. Before a user of the smart device 240 (here shown as a smartphone) can establish access to apparatus 200 for wireless communications, the devices must be paired, as is well known. For most ANDROID and IPHONE smart devices, this requires authentication via some suitable password, passkey and the like. As an example, to pair apparatus 200 with an ANDROID or IPHONE smart device, the user on his/her device typically will go to "Home-"→"Menu"→"Settings"→"Wireless & Networks" (or "Wireless Controls")→"Bluetooth Settings" to find this feature. The user of smart device 240 would select the Bluetooth box to turn on enabling, and then hold apparatus 200 near the smart device 240. The user then would tap "Scan for Devices", and wait until the name for apparatus 200 appears for selection/tapping. This connects apparatus 200 to the smart device 240. If the smart device 240 doesn't automatically pair, the user may be prompted enter a passcode or passkey generated for apparatus 200.

Turning to FIG. 15, and assuming that apparatus 200 and smart device 240 have been paired for BLUETOOTH communications using short-range RF radio wave signals, the user may iterate a number of features of an application downloaded and installed on his/her smart device 240 to interface with apparatus 200. In the example of FIG. 15, the application might include the example graphical user interface (GUI) or display 241 as shown, with "Dashboard", "Events" and "Contact Us" screens among other pages. In this specific example, the Dashboard screen view may present action icons to be tapped by the user, such as "Off" icon 242, "LOCK" icon 243, and "UNLOCK" icon 244. Additionally, the user may be presented with a visual indicator or icon 245 of battery life and additional information, such as is shown by element number 246 in FIG. 15.

In general, once paired, wireless communications between a user of the smart device 240 to control apparatus 200 can be understood as follows. With the system mode "Off", no current is applied by battery pack 230 to the actuator 250 or the associated electronics (control PCB 280, actuation control board 283). Upon selection or tapping the "LOCK" icon 243, the following operations occur: (i) a wireless signal is sent from the smart phone 240 to the control board 280; (ii) this is communicated by control board 280 to actuator board 283, which in turn (iii) sends a motor control signal to the armature in the motor of actuator 250 to cause the motor to rotate in one direction, which (iv) causes the piston 254 with foot 270 to travel downward to the floor surface to maintain door 205 secured. In this "lock state", any pressure or force moment exerted against the door 205 from the outside thereof will be sensed by pressure sensor 285, which in turn will cause an alert signal to be transmitted wirelessly from control board 280 to the smart device 240 for alert signal display thereon. An alarm indication will flash on display 241 to alert the user, may be accompanied by sound, and may be recorded by time, date and event on the events page (as shown by action icon 247). Conversely, upon selection or tapping the "UNLOCK" icon 244 to change system mode, the reverse operations occur.

Cyber hacking remains a concern; hence communication via BLUETOOTH protocol should be able to limit the possibility of the application becoming compromised. The application on smart device 240 only works within a certain distance of the apparatus 200, in one example a range of about between 5 to 30 m, in another specific example about 30 feet or less. If a hacker desired access, he/she would need to be already in the user's home specifically looking for that application on the user's smart device 240. This is not likely, and by this time the homeowner would be off to safety. Additionally, Bluetooth is more likely to be turned off on the user's smart device 240 rather than Wi-Fi in order to conserve battery life. Once off, Bluetooth hacking is not possible.

Figure 18:
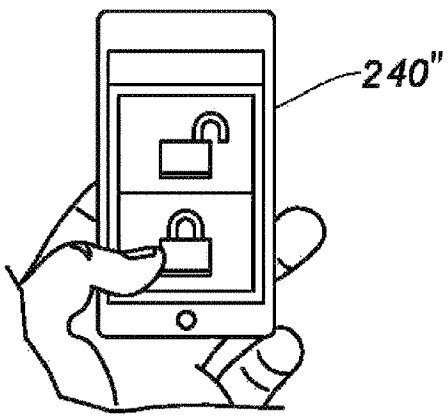
FIG. 18 is a front view of a smart phone illustrating another exemplary display for an application to control the apparatus of FIGS. 7-9 remotely.
Figure 16:
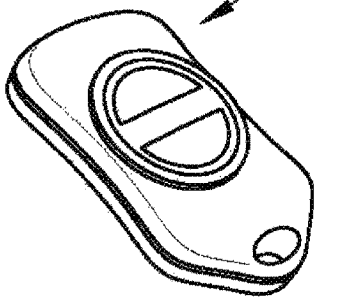
FIG. 16 is a perspective view of a key fob for remote control of the apparatus according to any of the example embodiments.

The smart device 240 has been described as being embodied as any of smartphones, phablets and tablets, smartwatches, smart bands and smart key chains, a smartphone example having being shown in FIG. 15. Accordingly, a downloaded and installed application on smart device 240 may be used to remotely control apparatus 200. However the smart device 240 may alternatively be embodied as a key fob 240' with intelligent electronics (stored instructions and control commands) therein, as shown in FIG. 16, or may be a smart device 240" which initiates a very simple lock/unlock protocol via a download and installed app, as shown by example in FIG. 18.

The example embodiments having been described, it is apparent that such have many varied applications. For example, the example embodiments may be applicable but not limited to connection to various devices, structures and articles.

The present invention, in its various embodiments, configurations, and aspects, includes components, systems and/or apparatuses substantially as depicted and described herein, including various embodiments, sub-combinations, and subsets thereof. Those of skill in the art will understand how to make and use the present invention after understanding the present disclosure. The present invention, in its various embodiments, configurations, and aspects, includes providing devices in the absence of items not depicted and/or described herein or in various embodiments, configurations, or aspects hereof, including in the absence of such items as may have been used in previous devices, e.g., for improving performance, achieving ease and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures to those claimed, whether or not such alternate, interchangeable and/or equivalent structures disclosed herein, and without intending to publicly dedicate any patentable subject matter.

I claim:

1. A removable, remotely-controlled door locking apparatus, comprising:

a rear plate for attachment against a surface of a door, a removable cover for enclosing components on the rear plate, a telescoping arm assembly connected at one end to the rear plate and extendible upward so that a second end of the telescoping arm assembly attaches to a door knob of the door, a DC-powered linear actuator enclosed within the removable cover and connected to the rear plate, at least one electronics module attached to the rear plate and configured to communicate wirelessly, a foot attached to a lower end of the DC-powered linear actuator, the foot configured under actuator control to be extended in a lock state against a floor surface to secure the door or retracted in an unlock state, based on a wireless signal received from a remote smart device to control the DC-powered linear actuator, and a pressure sensor attached to the rear plate for, upon receiving a control signal based on a user of the remote smart device placing the remotely-controlled door locking apparatus in the lock state with a wireless command signal transmitted to the at least one electronics module, sensing a movement condition of the door only from its locked state such that the at least one electronics module generates an alarm signal locally at the door, and issues a wireless alert message that is transmitted for display on the remote smart device of the user.

2. The remotely-controlled door locking apparatus of claim 1, wherein the at least one electronics module is embodied as a printed circuit board configured for wireless short-range RF communications with the remote smart device.

3. The remotely-controlled door locking apparatus of claim 1, wherein the remotely-controlled door locking apparatus and the remote smart device are each configured to be connected to a network, and the wireless signal is a Wi-Fi communications signal received by the at least one electronics module from the remote smart device.

4. The remotely-controlled door locking apparatus of claim 1, wherein the at least one electronics module is configured for wireless communications with the remote smart device utilizing standard Wi-Fi protocols.

5. The remotely-controlled door locking apparatus of claim 1, further comprising:

a plurality of electronics devices which include a control board attached to the rear plate for communicating wirelessly with the remote smart device and configured to send control signals to other electronic devices on the remotely-controlled door locking apparatus, and an actuation control board which controls the DC-powered linear actuator via a motor control signal, based on a control signal received via the control board from the remote smart device.

6. The remotely-controlled door locking apparatus of claim 1, wherein the remote smart device is selected from a group comprising smartphones, phablets and tablets, smartwatches, smart bands, and smart key chains.

7. The remotely-controlled door locking apparatus of claim 1, wherein the telescoping arm assembly includes attachment means affixed between part of the telescoping arm assembly and the surface of the door.

8. The remotely-controlled door locking apparatus of claim 7, wherein the attachment means is selected from a group comprising one or more suction cups, hook and loop material fasteners, and an adhesive.

9. The remotely-controlled door locking apparatus of claim 1, further comprising a spring loaded, door bottom holding lip that engages an underside of the door to assist in securing the remotely-controlled door locking apparatus thereto.

10. The remotely-controlled door locking apparatus of claim 1, further comprising:

a power supply to power the DC-powered linear actuator and at least one electronics module, the power supply embodied as one or more alkaline batteries or rechargeable batteries.

11. The remotely-controlled door locking apparatus of claim 1, further comprising:

a control board for communicating wirelessly with the remote smart device and to send control signals to other electronic devices in the remotely-controlled door locking apparatus, and an internal charger residing on the control board for charging one or more rechargeable batteries.

12. The remotely-controlled door locking apparatus of claim 1, wherein the telescoping arm assembly further includes a spring-biased hook at the second end of the telescoping arm assembly that is pivotable against spring pressure to secure the door knob thereby.

13. The remotely-controlled door locking apparatus of claim 1, wherein the telescoping arm assembly further includes:

a lower arm having a spring element with detents at an upper end of the lower arm, and an upper arm having a series of adjacent holes along a side at a lower end of the upper arm for receiving detents of the spring element, the spring compressible to enable length adjustment of the telescoping arm assembly depending on height of the doorknob above the apparatus cover.

14. The remotely-controlled door locking apparatus of claim 1, further comprising a pivotable, spring-biased door bottom holding lip attached to a lower portion of the rear plate, the pivotable, spring-biased door bottom holding lip rotatable about a pivot bar against spring pressure so the pivotable, spring-biased door bottom holding lip engages a slit or opening provided between a bottom of the door and a door stop or floor surface, so as to facilitate securing the remotely-controlled door locking apparatus against the door surface in conjunction with the telescoping arm assembly.

15. A removable, remotely-controlled door locking apparatus, comprising:

a rear plate having a plurality of electronic and mechanical components fixed thereon, a cover removably attached to the rear plate to enclose the plurality of electronic and mechanical components, a DC-powered linear actuator enclosed within the cover and connected to the rear plate, the DC-powered linear actuator including a piston rod terminating in a foot, the DC-powered linear actuator either extending or retracting the piston rod and foot in response to a wireless signal transmitted from a handheld smart device to the remotely-controlled door locking apparatus, a telescoping arm assembly connected at a lower end to the rear plate and the DC-powered linear actuator, and extendible upward so that an upper end of the telescoping arm assembly attaches to a door knob of a door so as to facilitate stabilizing the remotely-controlled door locking apparatus with the rear plate flush against a door surface, the telescoping arm assembly further including a spring-biased hook, the spring hook attached at its lower end to the upper of the telescoping arm assembly via a single pin, such that the spring-biased hook is rotatable by a user in a direction opposite to a direction of spring pressure applied thereto so as to latch with spring force to the door knob, and a spring loaded, door bottom holding lip attached to the rear plate that engages an underside of the door to assist, in conjunction with the telescoping arm assembly, securing the rear plate against the door surface.

16. The remotely-controlled door locking apparatus of claim 15, wherein the electronic components further include:

a control board attached to the rear plate for communicating wirelessly with the handheld smart device and configured to send control signals to other electronic devices on the remotely-controlled door locking apparatus, an actuation control board which controls the DC-powered linear actuator via a motor control signal, based on a control signal received via the control board from the handheld smart device, and a pressure sensor attached to the rear plate for sensing a movement condition of the door to generate an alarm signal that is audible, and transmitted wirelessly via the control board to the handheld smart device for display to a user of the handheld smart device, wherein the control board further includes an undervoltage circuit that, upon sensing a low voltage condition, sends a control signal via the actuation control board to de-energize the DC-powered linear actuator and retract the piston rod with foot from the floor surface.

17. The remotely-controlled door locking apparatus of claim 15, wherein the telescoping arm assembly includes one or more suction cups affixed between part of the telescoping arm assembly and the door surface.

18. A remotely-controlled door locking apparatus adapted to be removably secured against a door surface, comprising:

a rear plate adapted to be removably secured against the door surface, a removable cover attached to the rear plate, a control board attached to the rear plate for communicating wirelessly with a remote smart device and configured to send control signals to other electronic devices on the rear plate, a door bottom holding lip in contact with and spring-biased around a pivot bar, the spring pressure applied by a spring in contact with the door bottom holding lip and the pivot bar, the door bottom holding lip rotatable about the pivot bar against spring pressure exerted by the spring so as to enable the door bottom holding lip to engage a slit or opening provided between a bottom of the door and a door stop or floor surface, and an actuation control board which, based on a control signal wirelessly received via the control board from the remote smart device, sends a motor control signal to a DC-powered linear actuator so as to either extend a foot attached to a lower end of a piston of the DC-powered linear actuator to seat the foot against the floor surface, or retract the piston and foot to disengage the floor surface, wherein the control board further includes an undervoltage circuit that, upon sensing a low voltage condition, sends a control signal via the actuation control board to de-energize the DC-powered linear actuator and retract the piston with foot from the floor surface.

19. The remotely-controlled door locking apparatus of claim 18, further comprising:

a telescoping arm assembly connected at a lower end to the rear plate and to a bracket supporting the DC-powered linear actuator on the rear plate, the telescoping arm assembly extendible upward so that an upper end thereof attaches to a door knob of a door so as to facilitate stabilizing the remotely-controlled door locking apparatus with the rear plate flush against the door surface.

* * * * *